United States Patent [19]

Deller et al.

[11] 4,027,743

[45] June 7, 1977

[54] AXLE END OIL FILL AND LEAKAGE DETECTOR METHOD OF CHARGING LUBRICANT

[75] Inventors: Robert J. Deller; Edwin L. Carmel, both of Cincinnati, Ohio

[73] Assignee: Pullman Incorporated, Chicago, Ill.

[22] Filed: July 9, 1975

[21] Appl. No.: 594,385

[52] U.S. Cl. ..... 184/6.4; 184/105 R; 184/1 E; 308/95

[51] Int. Cl.[2] ..... F01M 1/20

[58] Field of Search ..... 184/105 R, 105 B, 55 R, 184/56 R, 1 E, 6.1, 6.4; 308/76, 78, 77, 95, 114, 122, 123, 187, 240, DIG. 9, 5; 60/657, DIG. 3; 123/41.33, 90.38, 196; 305/14; 141/7; 73/46

[56] References Cited

UNITED STATES PATENTS

| | | | |
|---|---|---|---|
| 2,611,450 | 9/1952 | Kalikow | 184/105 B |
| 3,481,431 | 12/1969 | Dorsey | 184/56 R X |
| 3,604,535 | 9/1971 | Whitaker | 184/56 R |

*Primary Examiner*—Richard C. Pinkham
*Assistant Examiner*—William R. Browne
*Attorney, Agent, or Firm*—Richard J. Myers

[57] ABSTRACT

A pressurized lubricant charging and leak detection apparatus and method to fill the lubricant reservoir of a wheel hub with lubricant and detect lubricant leaks therefrom. The apparatus includes a tubular filling probe which may be inserted into the hub which is connected through valving to a pressurized lubricant supply to fill the reservoir with lubricant and there with a pressurized air supply to charge air into the reservoir until a constant air pressure is established in the reservoir; whereafter, a drop in air pressure within the reservoir indicates lubricant leak from the hub.

7 Claims, 6 Drawing Figures

FIG. 2
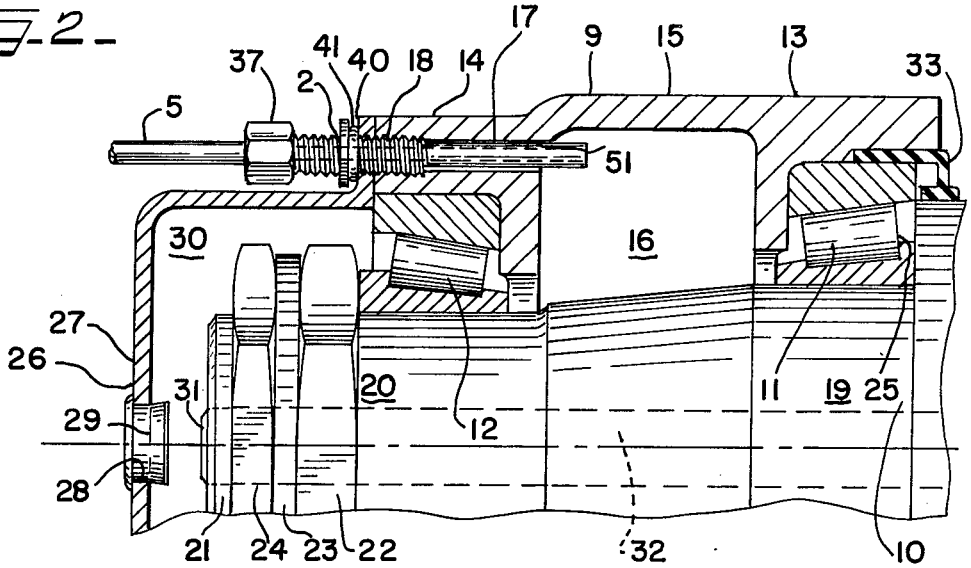
FIG. 1
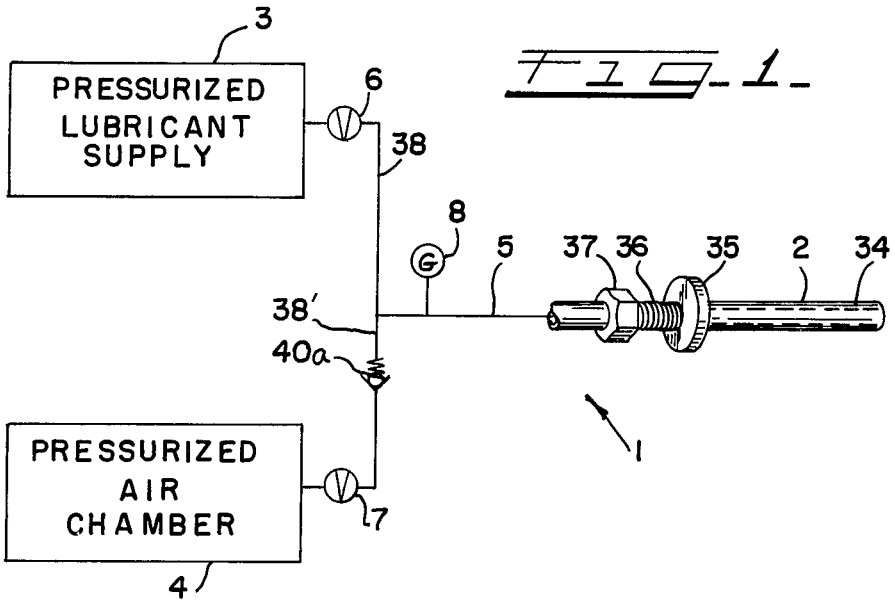
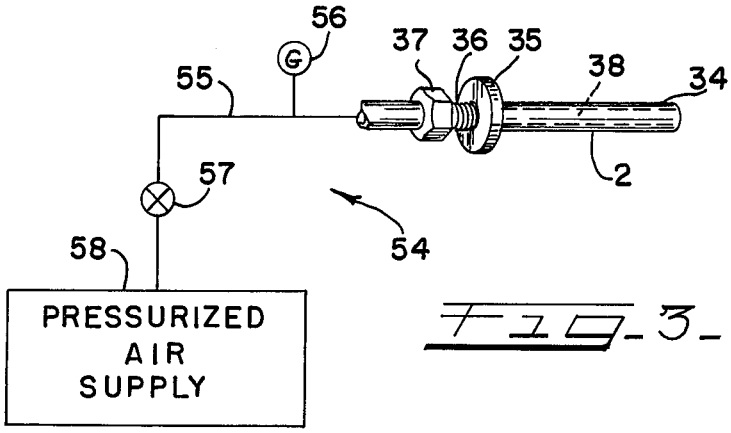
FIG. 3

AXLE END OIL FILL AND LEAKAGE DETECTOR METHOD OF CHARGING LUBRICANT

BACKGROUND OF THE INVENTION

1. Field of the Invention

The field of art to which this invention pertains to is the lubrication art, and more particularly to a lubricant filling device for a wheel hub.

2. Description of the Prior Art

The prior art discloses a variety of wheel hubs such as that shown in coapplicant's pending application Ser. No. 515,782, filed Oct. 17, 1974, disclosing a dual disc wheel for a highway trailer which is incorporated by reference herein.

The prior art discloses a variety of wheel hub designs having oil reservoirs within them which provide lubrication for the hub bearings which are sealed within the hub. However, because the reservoir must be sealed within the hub when it is mounted on the axle of a trailer or other vehicle, difficulty has been encountered in filling or charging the hub reservoir with oil and thereafter insuring the integrity of the seal of the reservoir within the hub. More particularly, in the past it has been necessary to monitor the hub for a substantial period of time after filling its reservoir with oil to determine if the reservoir is properly sealed within the hub. However, even when this procedure was rigidly adhered to, under static conditions oil leaks from the hub reservoir were not always detected until after the hub was put into service and the dynamics of the oil in the system and the temperature changes promoted leaks and the wheel bearings failed due to overheating and wear caused by inadequate lubrication.

The present invention presents a novel hub filling device and a facile method which momentarily detects leakage, one embodiment of the invention having a lubricant supply source and a pressurized air source connected to a common probe through which the reservoir is alternatively first charged with lubricant under high pressure and thereafter charged with air at a relatively low pressure without the necessity of disconnecting the apparatus from the hub assembly, whereby saving of time is attained and no additional equipment is required and which realistically simulates the dynamic conditions during operation of the mechanism.

SUMMARY OF THE INVENTION

This invention relates to a pressurized oil charging and leak detection apparatus and method for filling an internal oil reservoir of a wheel hub oil reservoir with oil.

It is therefore an object of the present invention to provide a pressurized lubricant charging and leak detection apparatus and method for filling an internal lubricant reservoir of a wheel hub with lubricant and detecting leakage of lubricant from the wheel hub.

It is another object of the present invention to provide a lubricant filling probe for an apparatus of the foregoing character which may be sealingly entrained within filling port provided in the wheel hub for filling the reservoir with lubricant at a pressure above ambient pressure.

These and other objects will become apparent from reference to the following description, attached drawings and appended claims.

DESCRIPTION OF THE DRAWING

FIG. 1 shows a schematic drawing of the pressurized oil changing and leak detecting apparatus;

FIG. 2 shows an axial sectional view of a wheel hub having the oil filling probe sealing engaged therein;

FIG. 3 shows a schematic drawing of the leak detecting apparatus;

DESCRIPTION OF THE PREFERRED EMBODIMENT

Figure 4:
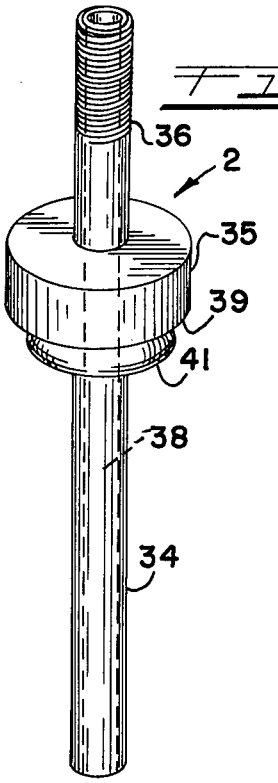
FIG. 4 shows a perspective view of the oil filling probe.

With reference to the drawings and in particular FIG. 1, there shown is a pressurized lubricant or oil supply and leak detecting system 1 for a wheel hub structure having an oil filling probe 2, a pressurized oil supply 3, and a pressurized air supply 4. The oil supply 3 and the air supply 4, are in selective fluid communication with the probe 2 through flexible hosing or pipe 5 which has valves 6 and 7 interposed between the oil supply 3 and the probe 2 and the air supply 4 and the probe 2, respectively. Additionally, a fluid pressure gage 8 is connected to the hose 5 on the probe side of the valves 6 and 7 to monitor fluid pressure in the probe.

As shown in FIG. 2, a wheel hub structure 9 is carried on an axle 10 through axially spaced inner bearing 11 and outer bearing 12 rollably secured within the hub 9. The hub structure includes an inner end portion 13 and an outer end portion 14 and a central annular web portion 15 extending therebetween and defining an internal torus-shaped oil reservoir 16 in fluid communication with the inner and outer bearings 11 and 12. An oil port 17 is provided which axially extends through the outer portion 14 to the oil reservoir 16. The port 17 includes an internally threaded end portion 18 sealed with a threaded plug (not shown in the drawings) which may be removed to insert the filling probe 2 into the port 17 to fill the reservoir 16 with oil.

The axle or spindle 10 includes a cylindrical inner bearing tracking portion 19 about which the inner bearing 11 is rollably engaged, and a cylindrical outer bearing tracking portion 20 about which the outer bearing 12 is rollably engaged. To axially secure the hub structure 9 on the axle 10, a threaded end 21 is provided on the outer end of the axle 10 which threadably engages nut 22, washer 23, and locknut 24 which prevent outward movement of the hub 9 on the axle 10. An annular step 25 is provided axially inward of the hub on the axle 10 to prevent inward movement of the hub 9 on the axle.

The hub structure is further provided with a cup-shaped hub cap 26 axially outwardly adjacent to the outer end portion 14 and enclosing the threaded end 21 of the axle 10 within the hub structure 9. The hub cap 26 is secured to the outer end portion 14 in a conventional manner (not shown in the drawings) and has an axially outer wall 27 provided with a port 28 having a removable hub cap plug 29 secured therein for fluidly sealing the interior 30 of the hub cap 26 within the hub structure 9 and in fluid communication with the oil reservoir 16 and therefore bearings 11 and 12. Additionally, a conventional axle end plug 31 is secured in the outer end of the bore 32 axially extending through the axle or spindle 10 to prevent loss of lubricating oil through the axle bore 32; and, in annular seal 33 rotatably engaging the axle 10 is secured within the inner end portion 13, adjacent and axially inward of the bearing 11, to seal the bearings 11 and 12, the oil reservoir 16, and the interior 30 of the hub cap 26 about the axle 10.

As seen in FIG. 4, the probe 2 is of a unitary tubular construction and includes a shank portion 34 or tubular member having one end which is receivable in the filling port 17, an annular shoulder or flange 35 in the central portion of the probe 2 having the tubular member 34 axially extending from one of its sides, a tubular connecting portion 36 axially extending from its other side, and an axial bore or fluid passage 38 providing fluid communication through the probe 2. To couple the flexible hosing or pipe 5 to the probe 2, and thereby provide fluid communication through the probe 2, hosing 5, and valves 6 and 7 to the oil and air supplies 3 and 4, a coupling 37 threadably engaged on the end of the coupling portion 36 is provided to conect the hose 5 and its branch portions 38 and 38' to the probe 2. The side face or sealing surface 39 of the shoulder 35 adjacent the shank portion 34 is a flat surface corresponding to a flat outer surface 40 of the outer end portion 14 in the proximity of the oil port 17. Additionally, an O-ring 41 is engaged about the shank portion 34 adjacent to the face 39 of the shoulder 35. Thus it can be seen that when the probe 2 is inserted into the port 17 to fill the reservoir 16 with oil, the shoulder face 39, O-ring 40 and outer surface 40 cooperatively seal the tubular shank portion 34 within the hub structure 9 such that the fluid pressure within the hub can be maintained above ambient pressure while the probe is engaged in the hub.

Lubricant under pressure flows through branch 38 to the probe 2 and into the portion of branch 38' downstream of a one way valve **40*a*** to block the lubricant from entry to the air supply source.

Figure 5:
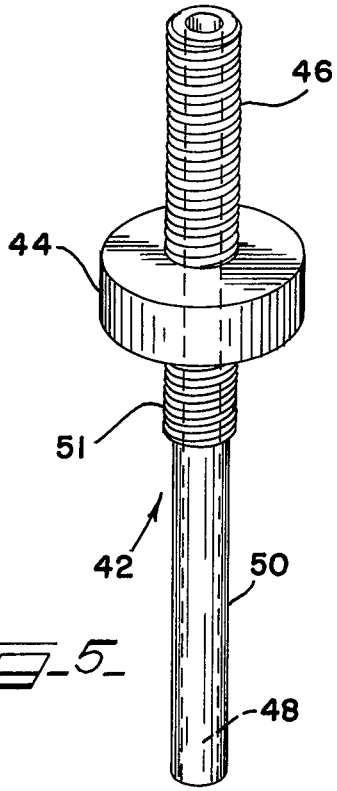
FIGS. 5 and 6 show modified embodiments of the probe.
Figure 6:
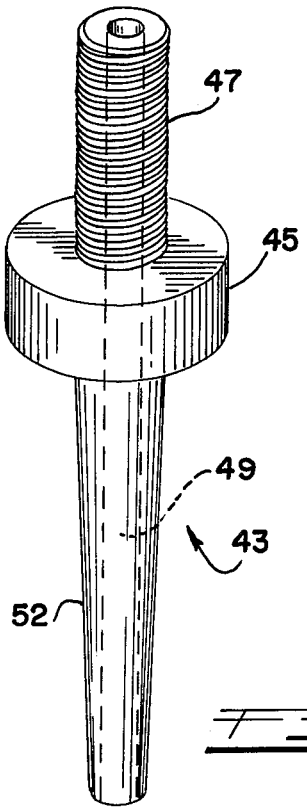

FIGS. 5 and 6 show two modified embodiments if the applicant's oil filling probe. Specifically, the threaded probe 42 shown in FIG. 5 and the tapered probe 43 shown in FIG. 6 are of a unitary tubular construction and are provided with annular shoulders 44 and 45, coupling portions 46 and 47, and axial bores or fluid passages 48 and 49, respectively, similar to those provided for the probe 2. However, the threaded tubular shank portion 50 of the probe 42 shown in FIG. 5 is provided with a threading 51 adjacent the shoulder 43 which is threadable engageable by the threading 18 in the oil port 17 to seal the probe 42 in the hub structure. This structure assures the integrity of the fluid seal about the probe 41 when it is engaged in the hub structure. This sealing feature is particularly important when high fluid pressures are to be maintained within the hub structure.

The structure of the tapered probe 43 includes a tapered tubular shank 52 which can be wedged in the oil filling port 17 to seal a portion of the periphery of the shank portion 52 within the hub structure. To enhance the integrity of the fluid seal between the tapered shank 52 and the wall 53 of the filling port 17, the probe is formed or machined from a thermoplastic or other slightly resilient material. By using such a material, the invention substantially increases the allowable machining and forming tolerances associated with the manufacture of the probe, thereby reducing the complexity and related cost of manufacture.

THE OPERATION

With the complement of apparatus described previously, the method of this invention may be explained as follows:

The oil filling probe 2 is introduced into the oil port 17 to extend into oil reservoir 16 and the flange or shoulder 35 is thereby wedged against the O-ring 41 which is compressed against the outer end portion 14 of the hub 9. Thus the portion of the probe extending into the reservoir 16 is sealed within the hub structure. While engaging the probe in the hub in this manner, the oil valve 6 is opened and the air valve 7 is normally closed such that oil is charged into the hub reservoir 16 by the pressurized oil supply 3 through the branch 38 of hosing 5 and the probe 2. Tests have shown that one desirable oil charging pressure for filling the hub structure with the desired quantity of oil was 40 p.s.i.g.

After hub is charged with oil, the valve 6 is closed after pressure is relieved, whereupon and the pressure within the hub returns to ambient conditions. The valve 7 is then opened to introduce air into the interior of the hub from the constant pressure air supply through the one way valve **40*a*, which opens, until a constant pressure is attained in the hub structure. Thereafter, the valve 7 is closed and the air pressure within the hub is monitored by the pressure gage 8. If the pressure remains constant while the probe is sealingly engaged in the hub 9**, there are no leaks in the hub structure; and conversely, if the pressure drops, oil is leaking or will leak from the hub. It has been found that a constant air pressure of 10 p.s.i.g. is sufficient to detect any leaks in the hub. In addition to the above, the oil may be heated prior to its introduction into the oil reservoir to improve its flow or viscosity.

The invention also provides that the applicant's method of detecting oil leaks be used alone. FIG. 3 shows a detection assemblly 54 providing for this method and includes the probe 2, hosing 55, pressure gage 56, valve 57, and air supply 58 where each of these respective components are of the same character as those described in regard to the supply and detection system 1.

It will be appreciated that in the present invention, the attempt is made to monitor potential problems by simulating dynamic conditions, that is when the ports are running. Under dynamic conditions lubricant pressure increases since a slinging (centrifugal) force is developed swirling the oil in the chamber and whereas the oil may remain in the chamber when the parts are static, the pumping action developed when the parts are running will pump the oil through broken seals etc.

From the above it can be seen that the invention provides an improved and novel means of rapidly filling a vehicle wheel hub with oil and of detecting fluid leakage from the hub structure. The foregoing description and drawings merely explain and illustrate the invention, however, the invention is not limited thereto, except insofar as the appended claims are so limited, as those skilled in the art who have the disclosure before them will be able to make modifications and variations therein without departing from the scope of the invention.

What is claimed is:

1. For a wheel hub including an outer end portion and a body portion, said body portion incuding a pair of axially spaced bearings and a closed lubrication reservoir between said bearings and in lubricating relation therewith, said outer end portion havng a selectably sealable lubricant filling port extending generally axially therethrough providing access between said lubricant reservoir and the exterior of the wheel hub, the improvement of a lubrication apparatus for charging lubricant into said lubricant reservoir and detecting leaks therefrom, including:

separate sources of pressurized lubricant and pressurized gas, a probe having an elongated shank insertably extendable through said lubricant filling port and into the lubricant reservoir and including sealing means cooperative with said outer end portion, valve means for selectively closing and opening respective sources to said lubricant reservoir, means for charging said lubricant reservoir under a predetermined pressure, means for dropping said pressure of the lubricant to ambient pressure, means for loading the lubricant reservoir with gas to a predetermined pressure after said lubricant reaches ambient pressure, and means for monitoring any pressure drop of the gas within the lubrication reservoir to thereby detect potential or actual leaks.

2. The invention according to claim 1, and said sealing means being an axially tapered portion provided in said shank wedgingly entrainable within said outer end portion.

3. The invention according to claim 1, and an annular shoulder portion provided for said shank having a sealing surface cooperative with said outer end portion to seal said shank therewithin.

4. The invention according to claim 1, and said sealing means being a resilient axially tapered portion provided in said shank wedgingly sealably entrainable within said outer end portion.

5. The invention according to claim 1 wherein said means for monitoring the pressure drop comprises a gauge and the means for dropping the pressure on the lubricant comprises closing off the valve means to the lubricant source and releasing the pressure on the lubricant.

6. A method of charging lubricant into an internal lubricant reservoir of a wheel hub through an associated lubricant filling port provided in the hub and of detecting fluid leaks therefrom, comprising:

sealingly engaging a filling probe within the filling port, opening lubricant valving to pass lubricant from a lubricant supply through the probe and into the reservoir at a pressure above ambient pressure to charge the reservoir with lubricant, closing the lubricant valving to stop the flow of lubricant into the reservoir, opening air valving to pass air from an air supply through the probe into the reservoir until a constant pressure above ambient pressure is attained, closing the air valving, and monitoring the air pressure in the reservoir through the probe with a pressure gauge in fluid communication therewith; whereby, fluid leakage from the hub is shown by a reduction in air pressure within the reservoir.

7. A method of lubricating a closed lubrication system and detecting lubricant leakage while the system is under static conditions and which simulates dynamic conditions comprising:

filling the system with lubricant under relatively high pressure displacing air in the system with the lubricant and compressing the air to a relatively small volume, then depressurizing the system and purging the air therein to return the system to ambient pressure then pressurizing the system with gas under relatively low predetermined pressure to slowly force the lubricant through the system, then closing the gas under said pressure from exhausting from the system, and thereafter monitoring the pressure of the gas in the system to determine if any pressure drop occurs thereby detecting potential leakage of the lubricant from said system under operating conditions.

* * * * *